US010900706B2

(12) United States Patent
Mckenzie

(10) Patent No.: US 10,900,706 B2
(45) Date of Patent: Jan. 26, 2021

(54) DOUBLE-TELESCOPING LEG LEVELER

(71) Applicant: Electrolux Home Products, Inc., Charlotte, NC (US)

(72) Inventor: Adam Mckenzie, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 99 days.

(21) Appl. No.: 16/224,911

(22) Filed: Dec. 19, 2018

(65) Prior Publication Data

US 2020/0200465 A1 Jun. 25, 2020

(51) Int. Cl.

| | |
|---|---|
| ***F16M 11/26*** | (2006.01) |
| ***F25D 23/00*** | (2006.01) |
| ***A47B 91/02*** | (2006.01) |
| ***D06F 39/12*** | (2006.01) |

(52) U.S. Cl.

CPC ..... *F25D 23/00* (2013.01); *A47B 91/022* (2013.01); *D06F 39/125* (2013.01); *F25B 2500/13* (2013.01); *F25D 2323/0011* (2013.01)

(58) Field of Classification Search

CPC ..... A47B 91/02; A47B 91/022; D06F 39/125; D06F 39/12; F25D 23/00; F16M 11/24; F16M 11/42; F16M 7/00

USPC ..... 248/188.1, 188.2, 188.4, 188.5; 16/18 R, 16/19, 29; 52/126.6

See application file for complete search history.

(56) References Cited

U.S. PATENT DOCUMENTS

| | | | | |
|---|---|---|---|---|
| 303,696 | A | 8/1884 | Blundon | |
| 1,173,990 | A | 2/1916 | Von der Lin | |
| 5,881,979 | A | 3/1999 | Rozier, Jr. et al. | |
| 6,027,086 | A | 2/2000 | Heitlinger et al. | |
| 6,363,685 | B1 * | 4/2002 | Kugler | E04F 15/02183 52/126.6 |
| 6,442,906 | B1 * | 9/2002 | Hwang | E04F 15/0247 248/188.4 |
| 6,520,461 | B1 | 2/2003 | Graham | |
| 7,744,050 | B2 * | 6/2010 | de Toledo | A47L 15/4253 248/188.3 |
| 7,866,096 | B2 * | 1/2011 | Lee | E04F 15/02488 52/126.6 |
| 7,866,614 | B2 | 1/2011 | Erdmann et al. | |
| 7,921,612 | B2 * | 4/2011 | Knight, III | B23Q 1/0054 52/126.6 |
| 8,002,224 | B2 | 8/2011 | Hamann | |
| 8,079,555 | B2 | 12/2011 | Erdmann et al. | |

(Continued)

FOREIGN PATENT DOCUMENTS

| | | |
|---|---|---|
| EP | 1118289 | 7/2001 |
| EP | 2962601 | 1/2016 |
| WO | 2018069103 | 4/2018 |

*Primary Examiner* — Todd M Epps

(74) *Attorney, Agent, or Firm* — Pearne & Gordon LLP

(57) ABSTRACT

A double-telescoping leg leveler is provided having an upper member, a central member, and a foot. The upper member is adapted to attach the leveler to an appliance. The central member includes an external thread pattern and is adapted to rotatably couple the foot to the upper member. The internal thread patterns of the foot and central member include a distal end that is shaped to enable a retraction of the leveler. The internal thread patterns of the foot and the central member are also configured to prevent the foot and central member from becoming disengaged from the leveler when extending the leveler.

16 Claims, 12 Drawing Sheets

(56) References Cited

U.S. PATENT DOCUMENTS

| | | | |
|---|---|---|---|
| 8,205,843 | B2 | 6/2012 | Phillips et al. |
| 2017/0224112 | A1 | 8/2017 | Devereux |
| 2017/0245640 | A1 | 8/2017 | Cheng |

* cited by examiner

DOUBLE-TELESCOPING LEG LEVELER

CROSS-REFERENCE TO RELATED APPLICATIONS

Not applicable.

FIELD OF THE INVENTION

This application relates generally to a leveling device for an appliance, and more particularly, to a double-telescoping leg leveler including telescoping members that cooperate relative to each other for increasing the overall height adjustment range of an appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventional appliances generally require leveling devices which are attached at a lower surface of the appliances for accommodating uneven floor surfaces. Typical leveling legs for appliances include a single threaded shaft formed with a foot as a unitary body, which results in a relatively large structure that must be accommodated by the appliance.

BRIEF SUMMARY OF THE INVENTION

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with one aspect, there is provided a double-telescoping leg leveler for supporting an appliance upon a surface that includes an upper member having a mounting portion and a post extending outwards therefrom, wherein the post is externally threaded. The mounting portion is adapted to attach the leveler to the appliance. The double-telescoping leg leveler also includes a central member having an external thread and a first internal thread. The first internal thread is rotatably engaged with the post to extend the central member away from the mounting portion when lengthening said leveler, and to retract the post into the central member when shortening said leveler. The double-telescoping leg leveler further includes a foot having a second internal thread. The second internal thread is rotatably engaged with the external thread of the central member to extend the foot away from the mounting portion when lengthening said leveler, and to retract the central member into the foot when shortening said leveler. An upper end of the first internal thread inclines forwardly from an inner wall of the central member to an edge of the first internal thread to facilitate assembly of the central member onto the post.

In accordance with another aspect, there is provided a leg leveler that includes an upper member having a threaded post, a central member having an external thread pattern and a first internal thread pattern, and a foot having a second internal thread pattern. The central member is interposed between the upper member and the foot. The central member is adapted to rotatably couple the foot to the upper member. A lower surface of the central member includes a first stop protrusion extending therefrom that is adapted to engage a distal end of the second internal thread pattern to prevent the foot from becoming disengaged from the central member.

It is to be understood that both the foregoing general description and the following detailed description present embodiments of the present disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure and together with the description serve to explain the principles and operations thereof.

BRIEF DESCRIPTION OF THE DRAWINGS

These and other features and aspects of the present disclosure can be further understood when read with reference to the accompanying drawings.

DESCRIPTION OF EXAMPLE EMBODIMENTS

Figure 1:
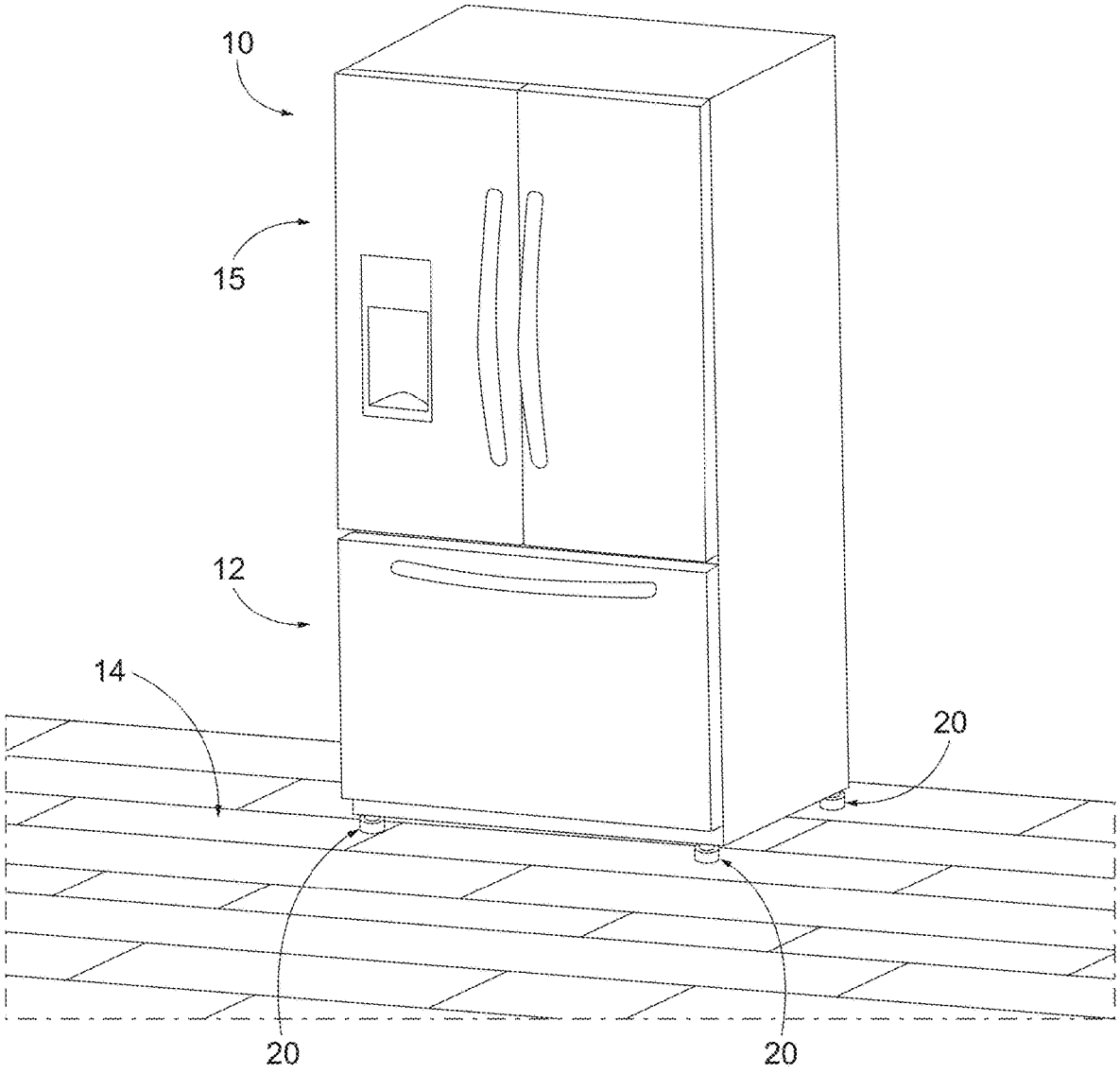
FIG. 1 is a front perspective view of a household refrigerator including an example double-telescoping leg leveler.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Referring now to the drawings, FIG. 1 shows a refrigeration appliance in the form of a domestic refrigerator, indicated generally at 10. Although the detailed description that follows concerns a domestic refrigerator 10, the invention can also be embodied by other appliances (e.g., an oven, dishwasher, laundry machine, etc.) or articles of furniture (e.g., table, chest, etc.). In particular, the shown embodiment of FIG. 1 is a bottom-mount configuration of a refrigerator appliance 10 including a fresh food compartment 15 disposed vertically above a freezer compartment 12. However, the appliance 10 can have any desired configuration including at least a fresh food compartment 15 and/or a freezer compartment 12, such as a top mount refrigerator (freezer disposed above the fresh food compartment), a side-by-side refrigerator (fresh food compartment is laterally next to the freezer compartment), or a standalone refrigerator or freezer, etc. In accordance with the present invention, the appliance 10 can include one or more double-telescoping leg levelers 20 for supporting the appliance 10 upon a surface 14, such as a kitchen floor. In the illustrated embodiment, the double-telescoping leg levelers 20 are located at a front lower surface and at a rear lower surface of the appliance 10 and are disposed one each at each corner of the appliance 10. However, it can be appreciated that other arrangements can also be contemplated for the leg levelers (e.g., at only the front lower surface, or only the back lower surface of the appliance).

One or more doors shown in FIG. 1 are pivotally coupled to a cabinet of the refrigerator 10 to restrict and grant access to the fresh food compartment 15. The door can include a single door that spans the entire lateral distance across the entrance to the fresh food compartment 15, or can include a pair of French-type doors as shown in FIG. 1 that collectively span the entire lateral distance of the entrance to the fresh food compartment 15 to enclose the fresh food compartment 15. For the latter configuration, a center flip mullion is pivotally coupled to at least one of the doors to establish a surface against which a seal provided to the other one of the doors can seal the entrance to the fresh food compartment 15 at a location between opposing side surfaces of the doors. The mullion can be pivotally coupled to the door to pivot between a first orientation that is substantially parallel to a planar surface of the door when the door is closed, and a different orientation when the door is opened. The externally-exposed surface of the center mullion is substantially parallel to the door when the center mullion is in the first orientation, and forms an angle other than parallel relative to the door when the center mullion is in the second orientation. The seal and the externally-exposed surface of the mullion cooperate approximately midway between the lateral sides of the fresh food compartment 15.

A dispenser for dispensing at least ice pieces, and optionally water, can be provided on an exterior of one of the doors that restricts access to the fresh food compartment 15. The dispenser includes an actuator (e.g., lever, switch, proximity sensor, etc.) to cause frozen ice pieces to be dispensed from an ice bin of an ice maker disposed within the fresh food compartment 15. Ice pieces from the ice bin can exit the ice bin through an aperture and be delivered to the dispenser via an ice chute, which extends at least partially through the door between the dispenser and the ice bin.

Referring to FIG. 1, the freezer compartment 12 is arranged vertically beneath the fresh food compartment 15. A drawer assembly (not shown) including one or more freezer baskets (not shown) can be withdrawn from the freezer compartment 12 to grant a user access to food items stored in the freezer compartment 12. The drawer assembly can be coupled to a freezer door that includes a handle. When a user grasps the handle and pulls the freezer door open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner that defines the fresh food compartment 15. The fresh food compartment 15 is located in the upper portion of the refrigerator 10 in this example and serves to minimize spoiling of articles of food stored therein. The fresh food compartment 15 accomplishes this by maintaining the temperature in the fresh food compartment 15 at a cool temperature that is typically above 0° C., so as not to freeze the articles of food in the fresh food compartment 15. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment 15 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 15 independent of the freezer compartment 12. According to an embodiment, the temperature in the fresh food compartment 15 can be maintained at a cool temperature within a close tolerance of a range between 0° C. and 4.5° C., including any subranges and any individual temperatures falling with that range. For example, other embodiments can optionally maintain the cool temperature within the fresh food compartment 15 within a reasonably close tolerance of a temperature between 0.25° C. and 4° C.

Figure 2:
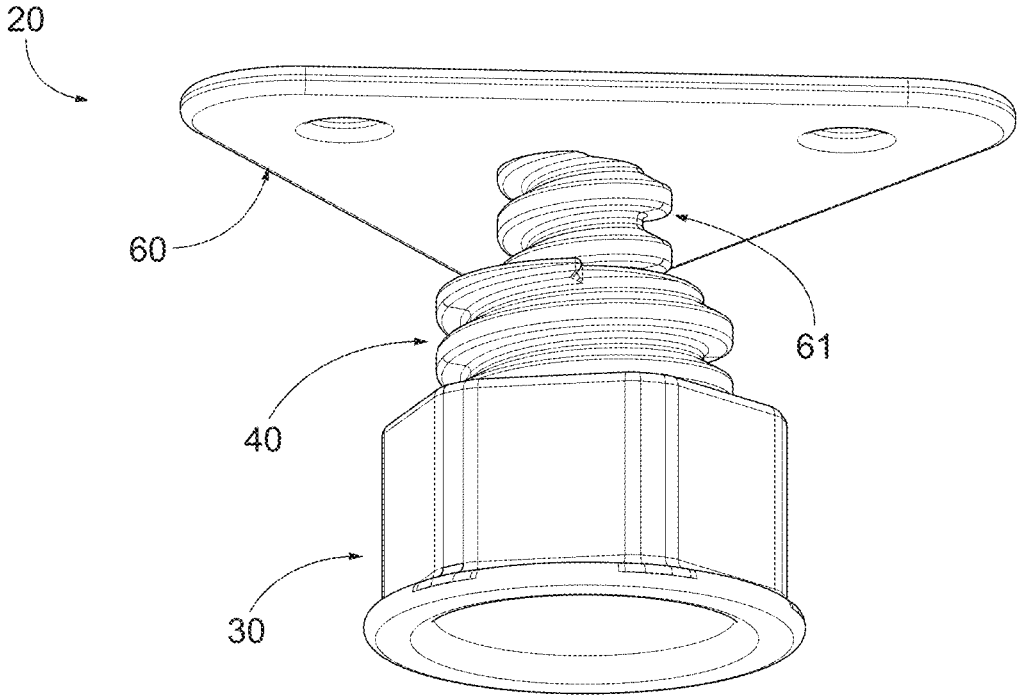
FIG. 2 is a perspective view an example double-telescoping leg leveler of the present application.

Turning to FIG. 2, an example of a double-telescoping leg leveler 20 is shown in an extended state. Generally, the double-telescoping leg leveler 20 provides a more robust, optimized, and space-saving design that includes telescoping members featuring thread patterns and stops that are configured to interlock with each other for preventing the disengagement of a respective telescoping member when extending the leveler. Finally, the telescoping members have internal thread patterns incorporating distal ends which are inclined for allowing users to more easily establish a rotation of a telescoping member when making an adjustment to retract the leveler.

Figure 3:
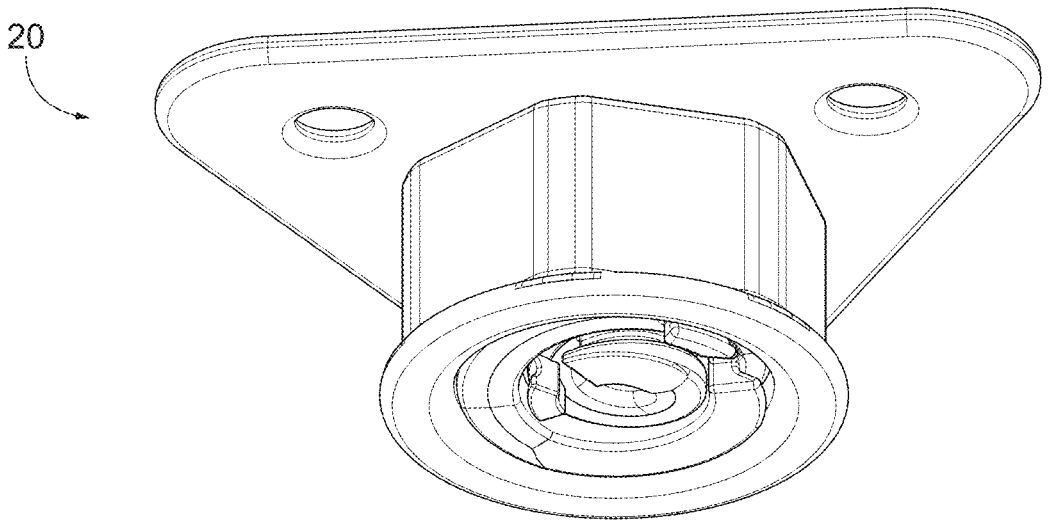
FIG. 3 is a perspective view of the leg leveler in a fully retracted position.

In the shown embodiment of FIG. 2, the double-telescoping leg leveler 20 comprises three telescoping members including a foot 30, a central member 40, and an upper member comprising a mounting bracket 60. Alternatively, one could visualize employing a fewer or greater quantity of telescoping members (e.g., two, or greater than three members). Functionally, the leveler 20 is configured to extend or retract to thereby level the appliance 10 upon an uneven surface 14 during installation of the appliance 10. The leveler 20 can also be employed to increase or decrease the height of the appliance 10. As shown in FIG. 2, the leveler 20 is illustrated in a fully extended state corresponding to a maximum height adjustment of the appliance 10. Conversely, and as shown in FIG. 3, the leveler 20 is presented in a fully retracted state corresponding to a minimum height of the appliance 10. Each leveler 20 is adjustable within the range of the maximum extended condition and minimum retracted condition. Generally, the leveler 20 is manufactured of a generally rigid material, such as metal or hard plastic.

Figure 4:
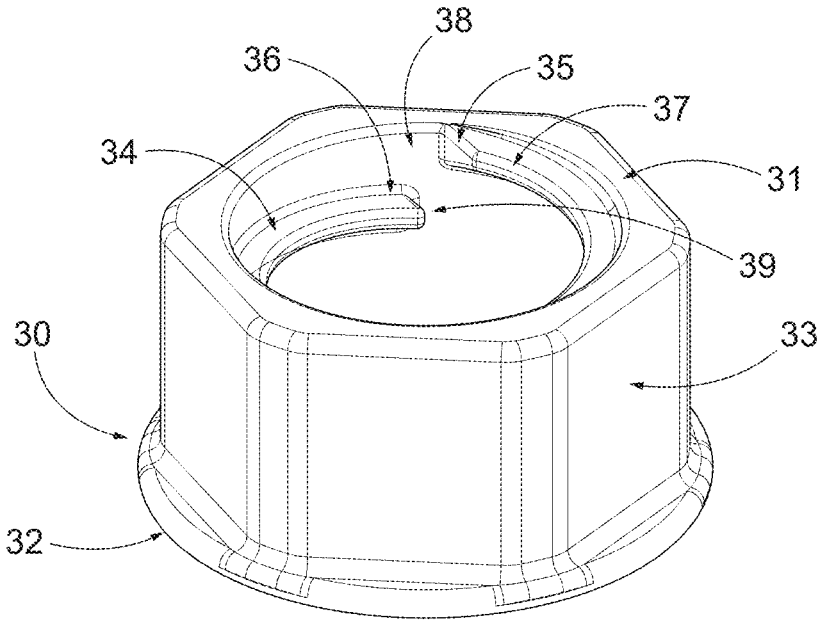
FIG. 4 is a perspective view of a foot of the leg leveler.

Referring to FIG. 4, the foot 30 of the leveler 20 is illustrated as a generally rigid, hexagonally-shaped nut. However, one can contemplate utilizing other configurations of a foot 30 (e.g., square-shaped, triangle-shaped, etc.) and preferably such configuration provides at least one, and preferably multiple, flat sides for engagement with a suitable tool, such as a wrench. Optionally, the foot 30 could be configured to be rotated by hand without the use of tools, and could include features to assist the user in gripping the foot, such as a friction surface and/or projecting wings, etc. In another alternative, the foot 30 could include structure to enable rotation by other tools, such as a tabs every 60 degrees (or other angle) that could be pushed with a screwdriver or the like. At a ground facing surface 14, the foot 30 optionally features a lip or pedestal 32 that is integrally attached thereto along an outer circumference of the foot 30. The pedestal 32 is configured to increase the stability of the leveler 20 as it rests on the surface 14. In another example (not shown), the pedestal 32 can be a separate component that is removably attached to the foot 30 (e.g., by way of fasteners, clasps, clips, etc.).

As shown in FIG. 4, the foot 30 includes a hole with an internal helical thread 34 that is formed to rotatably receive the central member 40 (FIG. 2) of the leveler 20. In another aspect, it can be appreciated that the foot 30 can include an internal helical thread pattern featuring a plurality of helical threads. The hole of the foot 30 can be a blind hole with a floor, or a through hole extending completely therethrough. In the shown example of FIG. 4, the internal helical thread 34 of the foot 30 includes a first end 35 and a second end 36. The first end 35 is formed such that it originates from an interior wall 38 of the foot 30, and inclines forwardly to a crest 37 of the internal helical thread 34 thereby giving the first end 35 a ramp-like, beveled appearance. Functionally, the first end 35 represents a tapered lead end that leads the internal helical thread 34 along the root R1 (FIG. 5B) of the external threads 42 of the central member 40, notably, when a user extends or retracts the foot 30 via linear movement along the central member 40 of the leveler 20. In this way, the first end 35 is configured to more easily align the internal helical thread 34 with a protrusion 52 on the bottom surface 50 of the central member 40 to facilitate assembly due to a tight interference fit between the foot 30 and the central member 40. Diametrically, the second end 36 (FIG. 4) of the internal helical thread 34 inclines backwardly from a distal end 39 to the interior wall 38 of the foot 30 creating a wedge-like appearance.

Figure 5A:
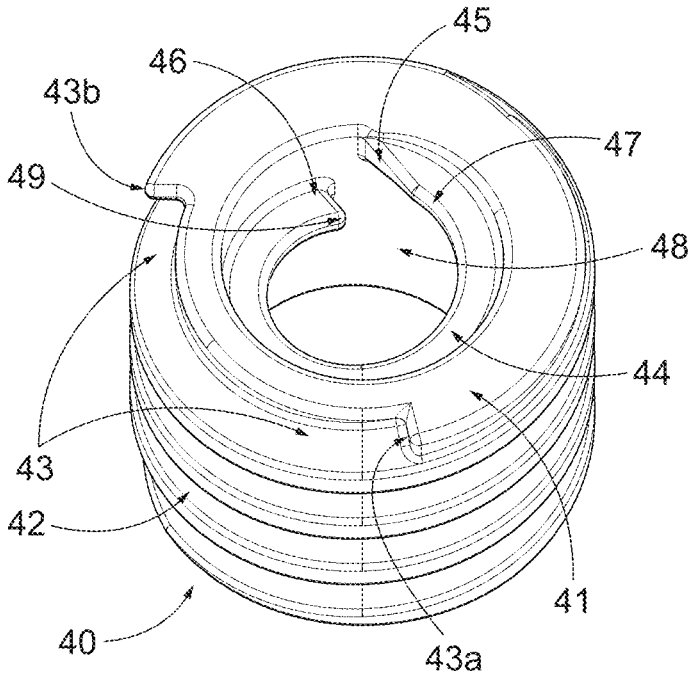
FIG. 5A is a perspective view of a central member of the leg leveler.
Figure 5B:
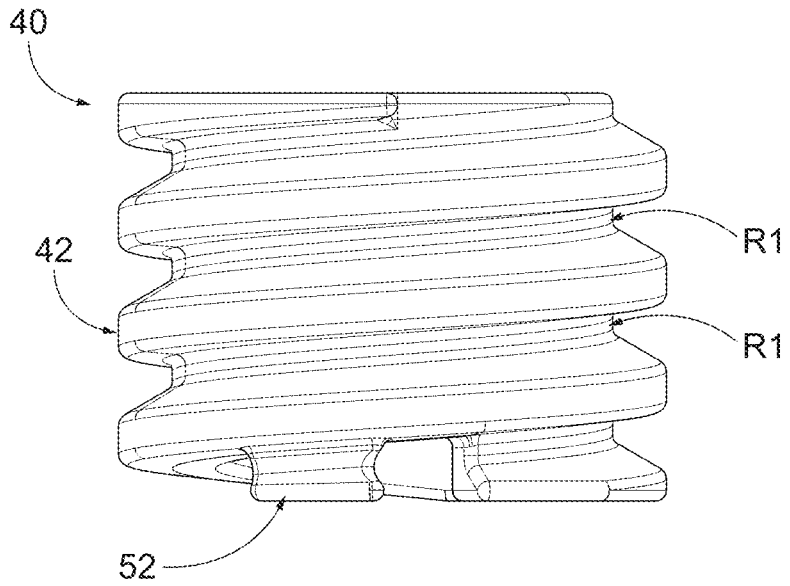
FIG. 5B is a side view of the mid-section of the leg leveler.

Turning back to FIG. 2, the central member 40 is an intermediate element that is configured to rotatably couple the foot 30 to the mounting bracket 60. The central member 40 also serves to rotatably and telescopically cooperate with the foot 30 and the mounting bracket 60 when extending or retracting the leveler 20 as described in greater detail below. Turning to FIG. 5A, the central member 40 is presented as a cylindrical member having external helical threads 42 and a hole with an internal helical thread 44. The hole of the central member 40 can be a blind hole with a floor, or a through hole extending completely therethrough. In another aspect, it can be appreciated that the central member 40 can include an internal helical thread pattern featuring a plurality of helical threads extending along an interior wall 48 of the central member 40. In the shown embodiment, the external helical threads 42 extend along the entire longitudinal periphery of the central member 40.

The internal helical thread 44 of the central member 40 features a first end 45 and a second end 46. The first end 45 is formed such that it originates from an interior wall 48 of the central member 40, and inclines forwardly to a crest 47 of the thread 44 creating a ramp-like, beveled appearance. Functionally, the first end 45 represents a lead end that leads the internal helical thread 44 along the root R2 (FIG. 7A) of external threads 62 formed on a vertical post 61 of the mounting bracket 60, notably, when a user retracts the central member 40 along a vertical post 61 of the mounting bracket 60. In this way, the first end 45 is configured to more easily align the internal helical thread 44 with a protrusion 68 on the bottom vertical post 61 of the mounting bracket 60 to facilitate assembly due to a tight interference fit between the central member 40 and the mounting bracket 60. Diametrically, the second end 46 (FIG. 5A) of the internal helical thread 44 inclines backwardly from a distal end 49 to the interior wall 48 of the central member 40 creating a wedge-like appearance.

A cut-away or recess 43 is formed along a circumference of a top surface 41 of the central member 40. The recess 43 is defined between a stop end 43*a* and the start end 43*b*. The start end 43*b* defines the upper start of the external threads 42 at the top of the central member 40. The stop end 43*a* provides a relatively flat or angled wall that is configured to interlock or inter-engage with the first end 35 of the internal helical thread 34 of the foot 30. In this way, the stop end 43*a* serves as a catch or stop to inhibit or prevent the foot 30 being over-threaded onto the central member 40 when the foot 30 is in the fully retracted position upon the central member 40 (i.e., the central member is at a fully retracted position into the hole of the foot), such as when the leveler 20 is in the overall fully retracted position (see FIG. 3). This engagement between the first end 35 and the stop end 43*a* further provides a positive tactile feedback to the user that the end limit of the foot 30 being screwed onto the central member 40 has been reached. In another example, when the leveler 20 is being retracted from an a partially or fully extended position (such as shown FIG. 2) towards a partially or fully retracted position (such as shown in FIG. 3), it is possible that the foot 30 may translate upon the central member 40 before the central member 40 translates upon the post 61. In this case, the foot 30 will threadingly rotate upon the central member 40 until the first end 35 of the internal helical thread 34 abuts the stop end 43*a* at the top of the central member 40. Thereafter, further rotational force applied to the foot 30 (i.e., by a wrench or other tool) will thereby be transferred into rotational force applied to the central member 40 for rotation upon the post 61. In this way the stop end 43*a* at the top of the central member 40 acts as the force transfer surface.

Figure 6:
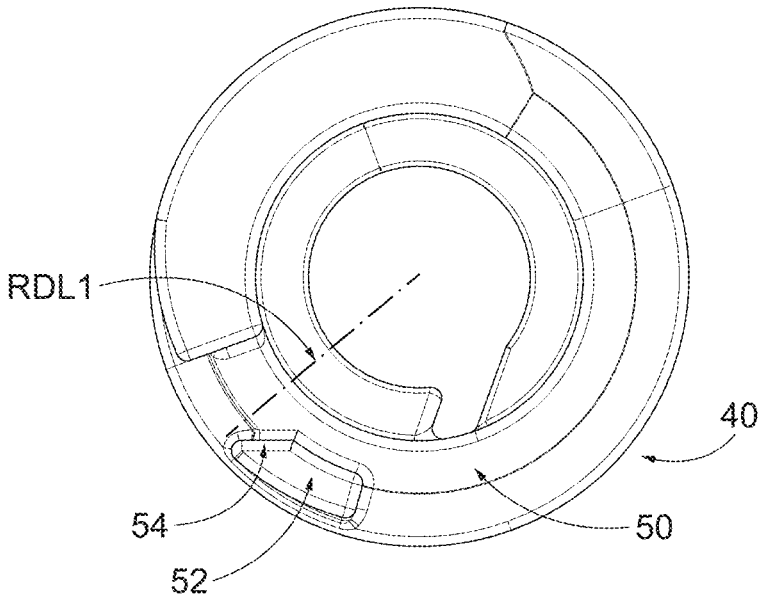
FIG. 6 is a is a bottom view of the mid-section of the leg leveler.

Referring to FIG. 6, a bottom surface 50 of the central member 40 includes the protrusion 52 that preferably is integrally formed thereon and spaced apart from the end of the thread(s) as a separate element. Optionally, the protrusion 52 could form an extended part of the thread(s) or could be part of the thread(s) that is separated from the main thread by an aperture or hole. In other examples, the protrusion 52 could be integral to the part or a separate part that is added or over molded. The protrusion 52 could be in the form of an interfering body, as shown, or alternatively could be a one-way moving clip like similar to an electrical connector snap, etc. A lower surface of the protrusion 52 features a chamfered edge 54, which will be described in detail below. In the shown embodiment, the chamfered edge 54 is obliquely oriented relative to a radial axis RDL1 of the central member 40. To minimize manufacturing costs, the protrusion 52 can be formed during the same process (e.g., plastic molding, CNC machining, etc.) that produces the external threads 42 of the central member 40. Optionally the protrusion 52 could be separately attached.

Figure 7A:
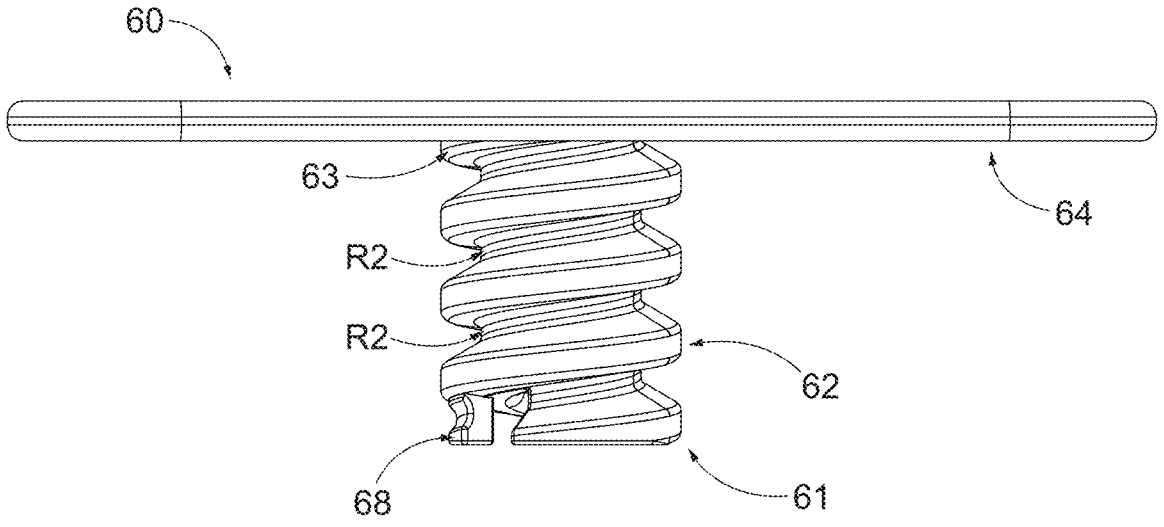
FIG. 7A is a side view of the mounting bracket of the leg leveler.

Turning to FIG. 7A, the mounting bracket 60 of the leveler 20 features a vertical member or post 61 and an upper member 64. In another aspect (not shown), the mounting bracket 60 could comprise a single member that is threadably inserted into the bottom of the appliance 10. Functionally, the mounting bracket 60 is suited to attach the leveler 20 to the bottom of the appliance 10.

Figure 7B:
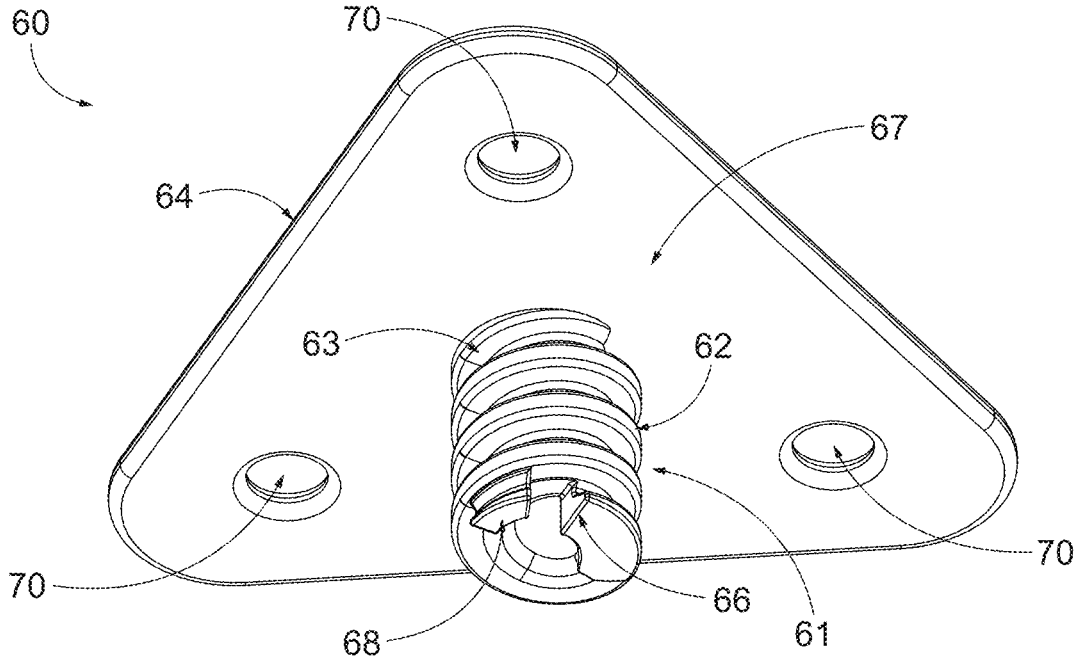
FIG. 7B is an underside perspective view of an example mounting bracket of the leg leveler.

In the shown embodiment of FIG. 7B, the upper member 64 is presented as a triangular-shaped flange. However, it can be appreciated that the upper member 64 can take on various other configurations (e.g., circular-shaped, or square-shaped). In another example, the upper member 64 can embody a rectangular component having a female thread through which the post 61 of the mounting bracket 60 is threadably inserted therethrough. In the shown example, the upper member 64 includes a plurality of holes 70 that are formed therethrough. The holes 70 serve to receive fasteners, such as bolts, screws, snap projections, etc. (not shown) that are employed to secure the assembled leveler 20 to the bottom surface of the appliance 10. In one example, the mounting bracket 60 could be attached to the bottom of the appliance by snapping the leg onto the appliance with a living hinge clip or the like.

Figure 7C:
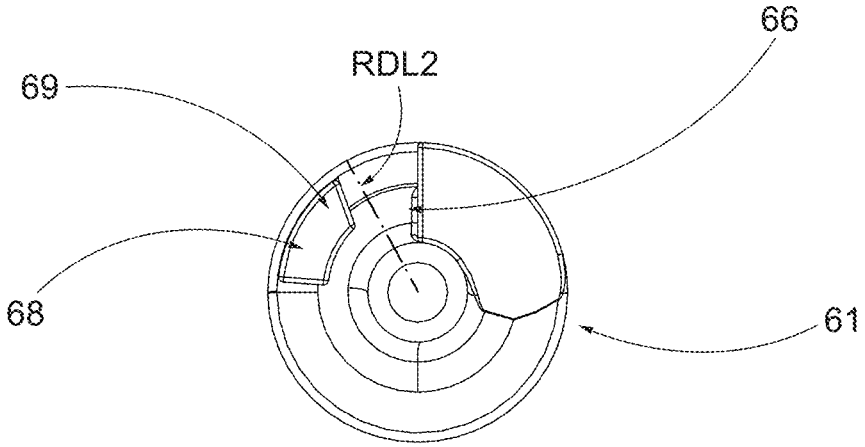
FIG. 7C is a bottom close up view of a post of the mounting bracket.

Referring to FIG. 7A, the post 61 features an external helical thread 62 that is formed along the longitudinal periphery of the post 61, and preferably along the entire longitudinal periphery of the post 61. An upper end of the post 61 features a single outwardly protruding thread 63 that is formed thereon. The post 61 also includes the protrusion 68 that is preferably integrally formed onto a lower surface of the post 61 and spaced apart from the end of the thread(s) as a separate element. In other examples, the protrusion 68 could be integral to the part or a separate part that is added or over molded. The protrusion 68 could be in the form of an interfering body, as shown, or alternatively could be a one-way moving clip like similar to an electrical connector snap, etc. Optionally, the protrusion 68 could form an extended part of the thread(s), or could be part of the thread(s) that is separated from the main thread by an aperture or hole. Referring to FIG. 7C, the protrusion 68 includes a beveled edge 69 that is obliquely oriented with respect to a radial axis RDL2 of the post 61. Like the protrusion 52 of the central member 40, the protrusion 68 of the post 61 can be formed during the same manufacturing process to minimize costs. Optionally the protrusion 68 could be separately attached.

Figure 8:
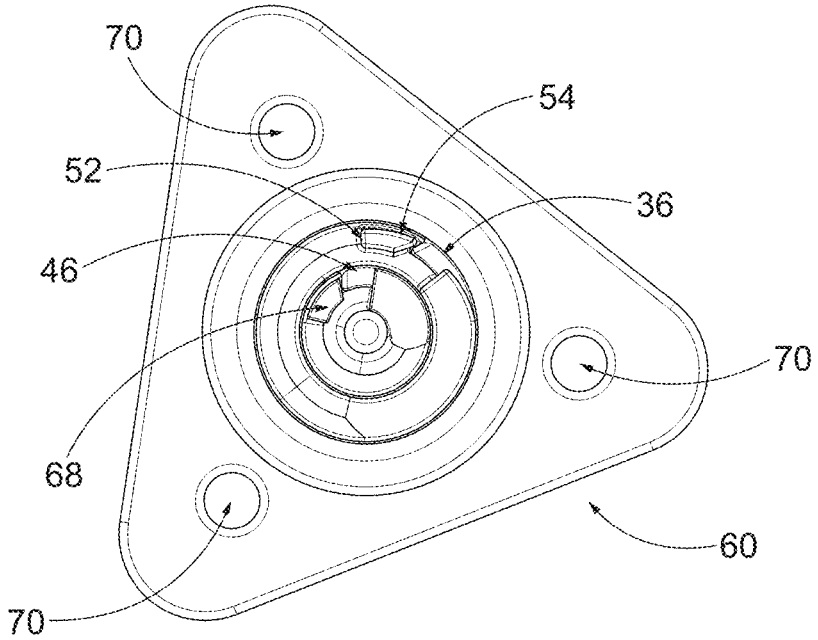
FIG. 8 is a bottom view of the leg leveler in a fully extended position.
Figure 9:
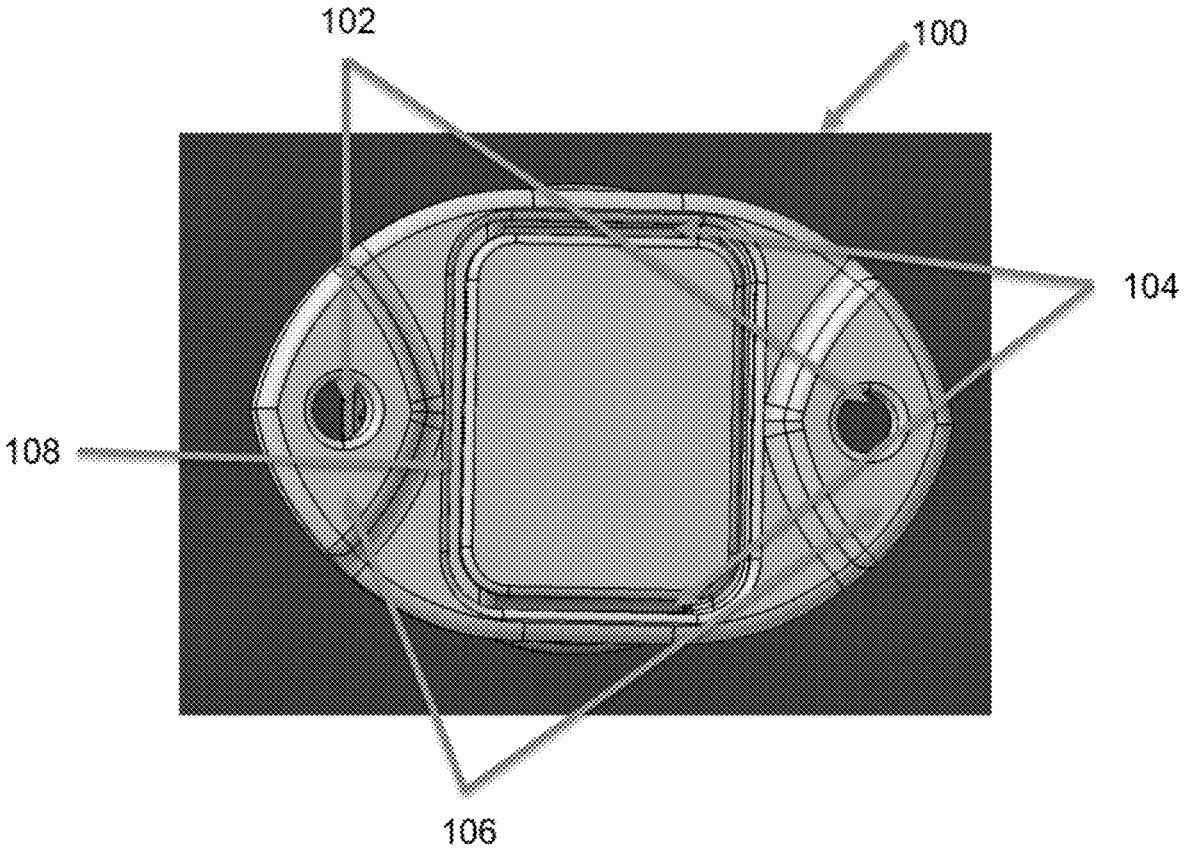
FIGS. 9-15 illustrate another embodiment of a leg leveler.
Figure 10:
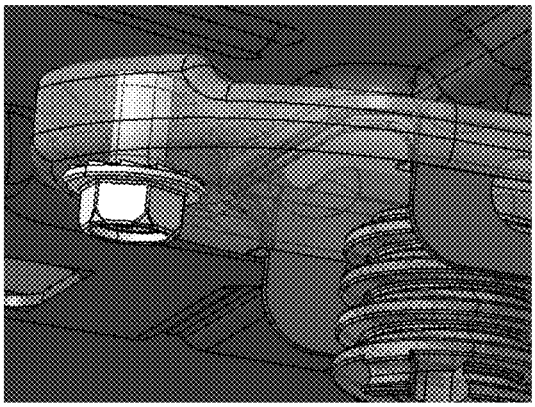
Figure 11:
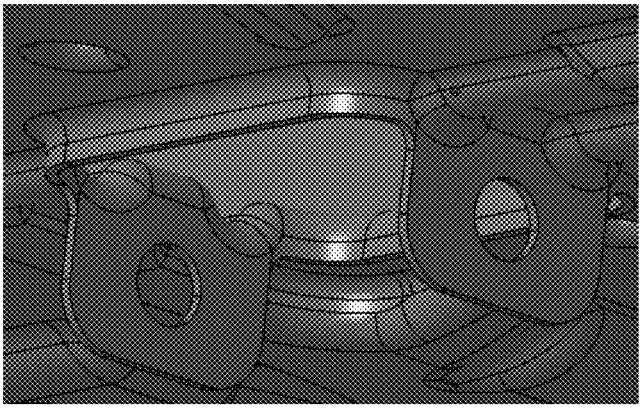
Figure 12:
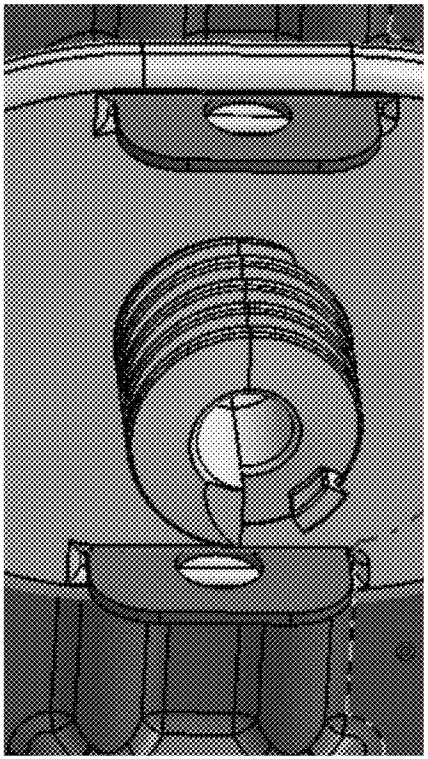
Figure 13:
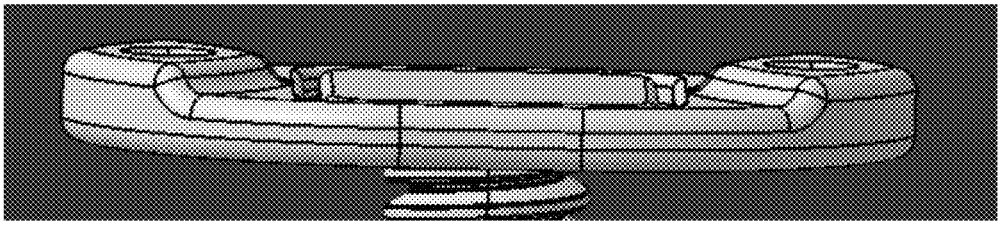
Figure 14:
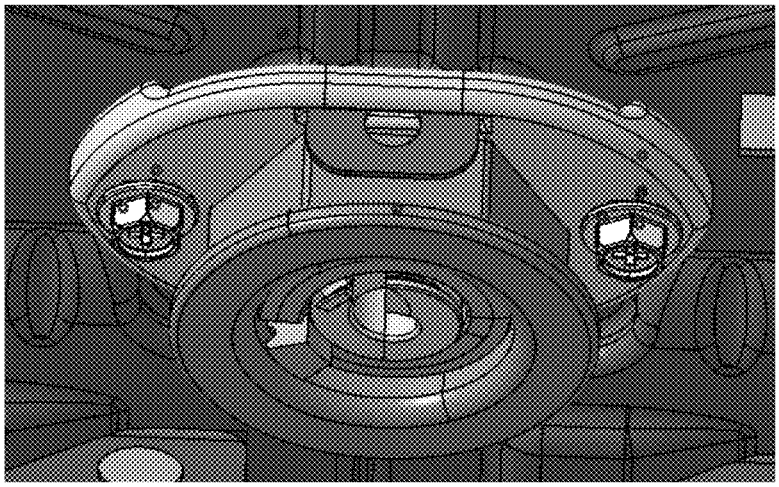
Figure 15:
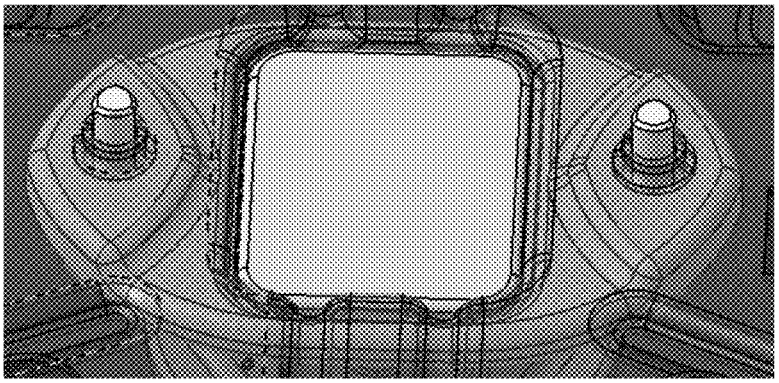

An example operation of the leg leveler 20 will now be described. To extend the leveler 20 from its nested and fully retracted position (FIG. 3), a tool (e.g., wrench) can be applied to the outer perimeter 33 (FIG. 4) of the foot 30. Although the following description will utilize the terms "clockwise" and "counter-clockwise" to describe the rotational directions, it is understood that these terms are not intended to limit the scope of the application, and the opposite direction could be utilized by adjusting or substituting the thread pitch (i.e., using a right-hand or left-hand thread, etc.). The structure and methodology described herein is intended to apply similarly to any thread type and rotational direction. By applying torque in a counter-clockwise direction, the foot 30 will begin to translation along the central member and away from the mounting bracket 60 to thereby extend away from the central member 40. As the foot 30 approaches a point corresponding to its maximum extension distance (FIG. 2), the protrusion 52 (FIG. 8) formed on the central member 40 will engage the wedge-shaped second end 36 of the internal helical thread 34 of the foot 30. In particular, the chamfered edge 54 of the protrusion 52 will engage the distal end 39 surface of the second end 36 such that protrusion 52 and second end 36 are interlocked or inter-engaged with each other. See FIG. 8. In this way, the second end 36 serves as a catch or stop to inhibit or prevent the foot 30 from becoming disengaged from the central member 40. This engagement with the second end 36 further provides a positive tactile feedback to the user that the end limit of the extension has been reached.

With a continued counter-clockwise rotation of the foot 30, the central member 40 will begin to extend away from the mounting bracket 60. It is to be appreciated that the engagement between the protrusion 52 and the second end 36 also enables the transfer of force from the foot 30 (i.e., force provided by the user's tool) to the central member 40 to thereby enable extension/retraction of the leg leveler 20. As the central member 40 approaches a point corresponding to its maximum height adjustment distance, the protrusion 68 formed on the post 61 of the mounting bracket 60 will engage the wedge-shaped second end 46 of the internal thread 44 formed in the central member 40. In particular, the beveled edge 69 (FIG. 7C) of the protrusion 68 will engage the second end 46 (FIG. 8) such that the protrusion 68 and second 46 are interlocked with each other. Hence, the protrusion 68 will serve as a catch or stop to inhibit or prevent the central member 40 from becoming disengaged from the vertical post 61 at a position corresponding to a maximum height adjustment distance of the leveler 20.

In another example, it can be appreciated that the central member 40 of the leveler 20 will extend away from the mounting bracket 60 before the foot 30 when first applying a counter-clockwise rotation to the outer perimeter 33 of the foot 30. As such, the sequence or order of extension (e.g., foot before central member or central member before foot) is not considered to be a limitation upon the claims.

To decrease the height of the leveler 20, the above operations can be performed in reverse. A tool (e.g., wrench) can be applied to the outer perimeter 33 of the foot 30 (FIG. 4). By applying torque in a clockwise direction, the internal helical thread 34 of the foot 30 (FIG. 4) will begin to travel along the root R1 of the external threads 42 (FIG. 5B) of the central member 40. When the foot 30 has fully traversed the longitudinal periphery of the central member 40, the stop end 43*a* at the recess 43 on the top of the central member 40 interlocks or inter-engages with the first end 35 of the internal helical thread 34 of the foot 30. With a continued clockwise rotation of the foot 30, the first end 45 of the internal helical thread 44 of the central member 40 will begin to travel along the root R2 of the external threads 62 (FIG. 7A) of the post 61. As discussed above, the first end 45 of the internal helical thread 44 makes it easier to accomplish a retraction leveling adjustment. With a continued clockwise rotation of the foot 30, a top surface 41 (FIG. 5A) of the central member 40 will make contact with a bottom surface 67 (FIG. 7B) of the mounting bracket 60. In this way, the top surface 41 of the central member 40 will be generally adjacent to and/or flush with a bottom surface 67 of the upper member 64. A top surface 31 of the foot 30 will also be generally adjacent to and/or flush with the bottom surface 67 (FIG. 7B) of the upper member 64, and may even make contact therewith. At this time, the leveler 20 will be in its fully retracted position corresponding to a minimum height of the leveler 20.

Alternatively, it can be appreciated that the foot 30 of the leveler 20 will retract before the central member 40 when first making a shortening height adjustment to the foot 30. Accordingly, the sequence or order of retraction (e.g., foot before mid-section, mid-section before foot) should not be limiting.

In another embodiment, turning now to FIGS. 9-15, it can be desirous to include a leg leveler at less than all corners of an appliance, or possibly at all corners. In most appliances, this is accomplished by installing a leveler at either the two front corners, or the two rear corners, or possibly at all four corners. However, in some appliances, some of the corners include structure to accommodate wheels or rollers that can enable the appliance to be more easily moved along a floor surface. It would be advantageous to have the ability to add a leg leveler to an appliance by utilizing the existing wheel or roller structure already present upon an appliance.

One solution is to utilize an adapter 100 that is configured to be secured to existing wheel or roller structure on the bottom of the appliance, whereby the adapter 100 corresponds to the mounting plate 60 previously described herein. The adapter 100 can include the vertical post 61 (previously described herein), to which is threadingly assembled the central member 40 and foot 30.

The adapter 100 includes mounting holes 102 that can accept screws, bolts, or other mechanical fasteners to attach the adapter 100 to the bottom of the appliance. The adapter 100 further includes clearance slots 104 extending therethrough (or comprising blind holes) that are already present upon the bottom of the appliance that previously accepted the wheel or roller axle. This feature in combination with the alignment groove (described below) will allow the leveler to use the same locating features as the roller. The outward wings or flange 106 of the adapter 100 can serve as the load bearing surface against the bottom of the appliance. Lastly, an alignment groove 108 can be provided at the general center of the adapter 100 that can correspond to and be received in an opening or hole of the bottom of the appliance that previously provided vertical clearance for the wheel or roller. Preferably, the extruded hole is made to help bear the load of the unit, so that the appliance weight will be supported by the alignment groove and larger flat areas around the mounting holes. Optionally, the groove in the leveler base is reversible. Thus, the use of the adapter 100 avoids the need for unique parts between appliance models, while also allowing a roller or a leg leveler to share the same location on the appliance.

Figure 16:
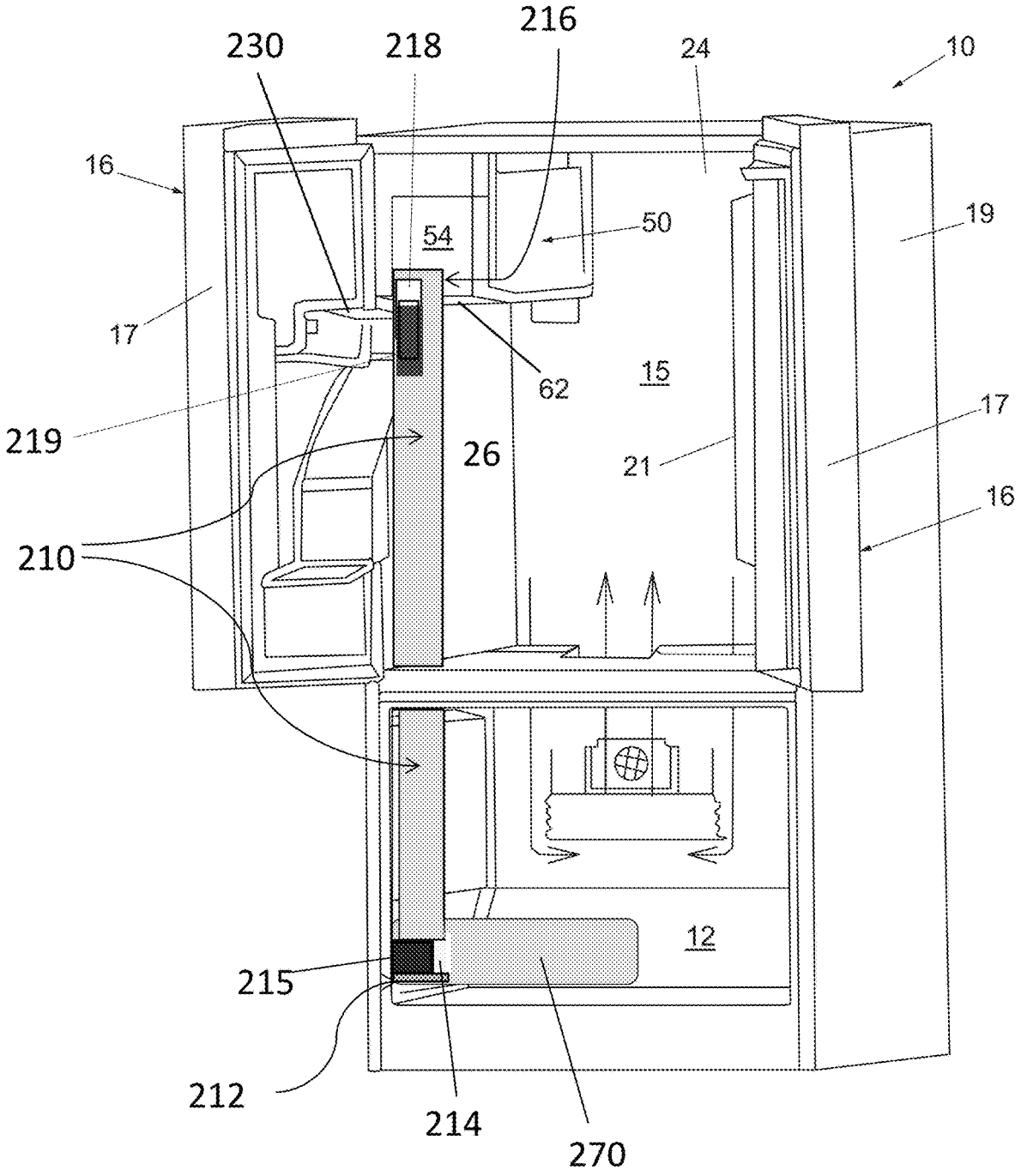
FIGS. 16-17 illustrate one example of an ice elevator.
Figure 17:
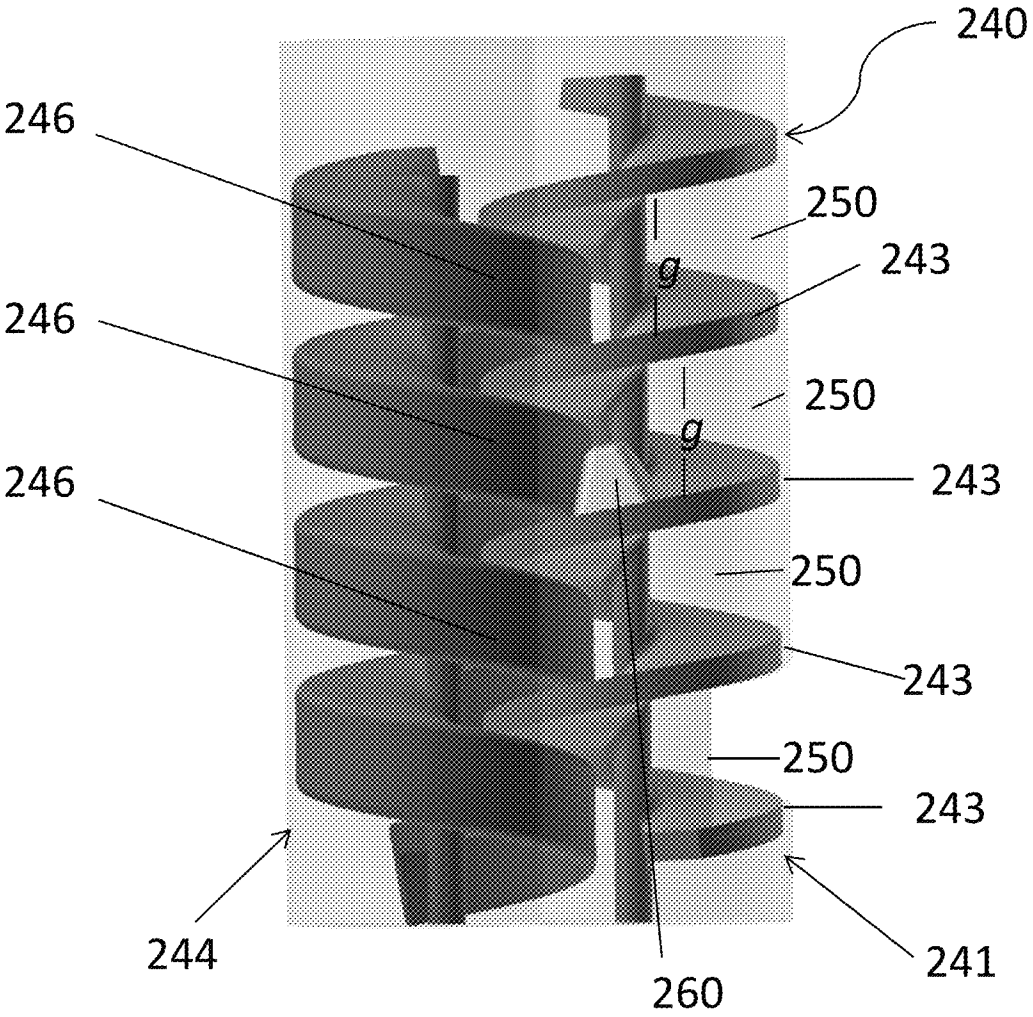

In another embodiment, turning now to FIGS. 16-17, the refrigerator 10 can include a vertical chute 210 (FIG. 16) for conveying ice cubes to an ice storage cavity 230 provided on a rear surface of the fresh food compartment door. The ice storage cavity 230 is devised to temporarily store and supply ice cubes to the dispenser located at the front of the door 16.

In one example, the vertical chute 210 is located near a front edge of a side wall 26 of the interior liner 24. In another example (not shown), the vertical chute 210 can be flush with a rear surface of the fresh food compartment door 16.

A lower end 212 of the vertical chute 210 is disposed in an ice storage bin 270 located in the freezer compartment 12. The lower end 212 features a lower opening 214 formed into a peripheral surface of the vertical chute 210. A horizontally-oriented slidable door 215 is provided to open or close the lower opening 214, as described in greater detail below. As can be appreciated, other configurations of a door or cover are also contemplated. For instance, one could envision utilizing a vertically-oriented slidable door, an elastic cover member, a curtain, or a sheath to conceal the lower opening 214.

The vertical chute 210 also includes an upper end 216 having an upper opening 218 that is formed into a peripheral surface of the vertical chute 210. A vertically-oriented slidable door 219 is arranged to open or close the upper opening 218. However, other examples of a door or cover can be utilized (e.g., horizontally-oriented slidable door, elastic cover member, curtain, sheath, etc.). The upper opening 218 is positioned slightly above the top of the ice storage cavity 230 such that ice cubes exiting the upper opening 218 fall directly into the ice storage cavity 230 by way of gravity.

Referring to FIG. 17, a twin screw ice elevator 240 is disposed within the vertical chute 210 for conveying ice cubes stored in the ice storage bin 270 of the freezer compartment 12 to the ice storage cavity 230 of the fresh food compartment door 16. The ice elevator 240 features a first interlocking helical screw 241 and a second interlocking helical screw 244 that cooperate relative to each other to define a travelling storage space 250 (e.g., cup) for ice cubes (e.g., see ice cube 260) that are conveyed up and through the vertical chute 210. Particularly, the storage space 250 is defined by a gap g that is created between helical blades 243 of the first helical screw 241, and by a lateral surface 246 of the second interlocking helical screw 244.

To operate the ice elevator 240, a horizontal auger (not shown) is provided within the ice storage bin 270 of the freezer compartment 12 for conveying ice cubes into the lower opening 214 of the vertical chute 210. Further, a sensor (not shown) is utilized to detect an ice cube storage level within the ice storage cavity 230, such that the ice elevator 240 is only operated when ice cubes stored within the ice storage cavity 230 fall below a minimum, prescribed level. When the sensor detects a need for additional ice cubes, the slidable doors 215 and 219 of the vertical chute 210 slide open to expose the lower and upper openings 214 and 218. Next, the horizontal auger provided in the ice storage bin 270 is actuated to convey ice cubes into the lower opening 214 of the vertical chute 210. At this time, the interlocking helical screws 241 and 244 begin to rotate in opposite directions relative to each other, such that ice cubes entering the lower opening 214 are received in the travelling storage space 250 defined by the first and second interlocking helical screws 241 and 244. As the interlocking screws 241 and 244 continue to rotate, ice cubes are conveyed through the vertical chute 210. The ice cubes exit the vertical chute 210 at the upper opening 218 after being fully elevated by the ice elevator 240. At this time, the ice cubes drop into the ice storage cavity 230 located in the fresh food compartment door 16. When the sensor detects that the ice storage cavity 230 is approaching its maximum capacity, the horizontal auger is deactivated, and the lower slidable door 215 of the vertical chute 210 closes to conceal the lower opening 214. Finally, the upper slidable door 219 closes to conceal the upper opening 218 after a predetermined time value has been attained, corresponding to the amount of time it takes to fully elevate all of the remaining ice cubes stored within the storage spaces 250 of the ice elevator 240.

The aforementioned design enables ice production to take place within the freezer compartment 12, thereby increasing ice making production due to the convection cooling provided by the freezer compartment 12. Further, by moving the ice making production to the freezer compartment 12, the storage volume of the fresh food compartment 15 can be increased.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A double-telescoping leg leveler for supporting an appliance upon a surface, comprising:

an upper member having a mounting portion and a post extending outwards therefrom, wherein the post is externally threaded, and wherein the mounting portion is adapted to attach said leveler to said appliance;

a central member having an external thread and a first internal thread, wherein the first internal thread is rotatably engaged with the post, the central member being configured to move away from the mounting portion when said leveler is extended, and the post being configured to move into the central member when said leveler is retracted;

a foot having a second internal thread, wherein the second internal thread is rotatably engaged with the external thread of the central member, the foot being configured to move away from the mounting portion when said leveler is extended, and the central member being configured to move into the foot when said leveler is retracted;

wherein an upper end of the first internal thread inclines forwardly from an inner wall of the central member to an edge of the first internal thread to facilitate assembly of the central member onto the post, and wherein a recess is formed into a top surface of the central member and defines a stop end that is configured to engage with an end of the second internal thread of the foot when the central member is at a fully retracted position into the foot.

2. The double-telescoping leg leveler of claim 1, wherein an upper end of the second internal thread inclines forwardly from an inner wall of the foot to an edge of the second internal thread to facilitate assembly of the foot onto the central member.

3. The double-telescoping leg leveler of claim 1, wherein a lower end of the first internal thread inclines backwardly from an edge of the first internal thread to an inner wall of the central member to create a first catch.

4. The double-telescoping leg leveler of claim 3, wherein a first stop protrusion is formed onto a lower surface of the post and is adapted to engage the first catch to prevent the central member from being fully disengaged from the post.

5. The double-telescoping leg leveler of claim 1, wherein the mounting portion includes a through hole for attaching the leveler to a bottom of said appliance.

6. A double-telescoping leg leveler for supporting an appliance upon a surface, comprising:

an upper member having a mounting portion and a post extending outwards therefrom, wherein the post is externally threaded, and wherein the mounting portion is adapted to attach said leveler to said appliance;

a central member having an external thread and a first internal thread, wherein the first internal thread is rotatably engaged with the post, the central member being configured to move away from the mounting portion when said leveler is extended, and the post being configured to move into the central member when said leveler is retracted;

a foot having a second internal thread, wherein the second internal thread is rotatably engaged with the external thread of the central member, the foot being configured to move away from the mounting portion when said leveler is extended, and the central member being configured to move into the foot when said leveler is retracted;

wherein an upper end of the first internal thread inclines forwardly from an inner wall of the central member to an edge of the first internal thread to facilitate assembly of the central member onto the post, wherein a lower end of the second internal thread inclines backwardly from an edge of the second internal thread to an inner wall of the foot to create a second catch.

7. The double-telescoping leg leveler of claim 6, wherein a second stop protrusion is formed onto a lower surface of the central member and is adapted to engage the second catch to prevent the foot from being fully disengaged from the central member.

8. A leg leveler for supporting an appliance upon a surface, comprising:

an upper member having a threaded post;

a central member having an external thread pattern and a first internal thread pattern;

a foot having a second internal thread pattern;

wherein the central member is interposed between the upper member and the foot, and wherein the central member is adapted to rotatably couple the foot to the upper member; and wherein a lower surface of the central member includes a first stop protrusion extending therefrom that is adapted to engage a distal end of the second internal thread pattern to prevent the foot from becoming disengaged from the central member.

9. The leg leveler of claim 8, wherein a lower surface of the threaded post includes a second stop protrusion extending therefrom that is adapted to engage a distal end of the first internal thread pattern of the central member to prevent the central member from becoming disengaged from the upper member.

10. The leg leveler of claim 8, wherein the second internal thread pattern of the foot includes a terminal end that inclines forwardly from an inner wall of the foot to an edge of the second internal thread pattern to facilitate assembly of the foot onto the central member.

11. The leg leveler of claim 8, wherein the first internal thread pattern of the central member includes a terminal end that inclines forwardly from an inner wall of the central member to an edge of the first internal thread pattern to facilitate assembly of the central member onto the upper member.

12. The leg leveler of claim 8, wherein the upper member comprises a mounting portion that is adapted to attach said leveler to said appliance, and the threaded post extends outwardly from the mounting portion.

13. The leg leveler of claim 12, wherein the first internal thread pattern of the central member is rotatably engaged with the threaded post, the central member being configured to move away from the mounting portion when said leveler is extended, and the post being configured to move into the central member when said leveler is retracted.

14. The leg leveler of claim 12, wherein the second internal thread pattern of the foot is rotatably engaged with the external thread pattern of the central member, the foot being configured to move away from the mounting portion when said leveler is extended, and the central member being configured to move into the foot when said leveler is retracted.

15. The leg leveler of claim 14, wherein a recess is formed into a top surface of the central member and defines a stop end that is configured to engage with an end of the second internal thread pattern of the foot when the central member is at a fully retracted position into the foot.

16. The leg leveler of claim 12, wherein the mounting portion includes a through hole for attaching the leveler to a bottom of said appliance.

* * * * *